US007371424B2

(12) United States Patent
Schwarz

(10) Patent No.: US 7,371,424 B2
(45) Date of Patent: May 13, 2008

(54) METHOD AND APPARATUS FOR COATING A MEDICAL DEVICE USING A COATING HEAD

(75) Inventor: Marlene C. Schwarz, Newton, MA (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 362 days.

(21) Appl. No.: 10/823,636

(22) Filed: Apr. 14, 2004

(65) Prior Publication Data

US 2005/0233061 A1 Oct. 20, 2005

(51) Int. Cl.
*B05D 1/30* (2006.01)

(52) U.S. Cl. ..... 427/2.24; 427/2.25; 427/2.26; 427/2.28; 427/2.3

(58) Field of Classification Search ..... None
See application file for complete search history.

(56) References Cited

U.S. PATENT DOCUMENTS

| | | | | |
|---|---|---|---|---|
| 4,572,849 | A | 2/1986 | Koepke et al. | |
| 4,863,765 | A | 9/1989 | Ishizuka | |
| 5,017,118 | A | 5/1991 | Looman et al. | |
| H1003 | H | 12/1991 | Ishiwata et al. | |
| 5,091,205 | A | 2/1992 | Fan | |
| 5,097,792 | A | 3/1992 | Umemura et al. | |
| 5,175,028 | A | 12/1992 | Tanaka et al. | |
| 5,275,660 | A | 1/1994 | Ozaki et al. | |
| 5,700,524 | A | 12/1997 | Hoff et al. | |
| 5,702,754 | A | 12/1997 | Zhong | |
| 5,728,430 | A | 3/1998 | Sartor et al. | |
| 5,780,109 | A | 7/1998 | Yapel et al. | |
| 5,843,530 | A | 12/1998 | Jerry et al. | |
| 5,849,363 | A | 12/1998 | Yapel et al. | |
| 5,861,195 | A | 1/1999 | Bhave et al. | |
| 5,962,075 | A | 10/1999 | Sartor et al. | |
| 6,007,874 | A | 12/1999 | Bhave et al. | |
| 6,200,641 | B1 | 3/2001 | Bhave et al. | |
| 6,214,111 | B1 | 4/2001 | Yapel et al. | |
| 6,616,765 | B1 * | 9/2003 | Castro et al. | 118/669 |
| 6,682,771 | B2 * | 1/2004 | Zhong et al. | 427/2.24 |
| 6,709,455 | B1 | 3/2004 | Chouinard | |

FOREIGN PATENT DOCUMENTS

| | | | |
|---|---|---|---|
| GB | 1 276 381 | A | 6/1972 |
| JP | 2003-236434 | * | 8/2003 |

OTHER PUBLICATIONS

Lee et al, Chemical Engineering Science, 47(7), pp. 1703-1713, 1992.*
Valentini et al, Ind. Eng. Chem. Res. 30, pp. 453-461, 1991.*

* cited by examiner

*Primary Examiner*—Erma Cameron
(74) *Attorney, Agent, or Firm*—Kenyon & Kenyon LLP

(57) ABSTRACT

Methods and apparatuses for coating surface of medical devices using coating heads are disclosed. In one embodiment, the invention includes a coating method using a coating head, wherein the coating head comprises at least one outlet orifice from which flows a coating material, to deposit at least one layer of coating material dispelled through the outlet orifice onto the surface of the medical device. In another embodiment, a slide coating head is used to deposit multiple layers of superposed coating materials. These methods are used to apply one or more coating materials, simultaneously or in sequence. In certain embodiments of the invention, the coating materials include therapeutic agents, polymers, sugars, waxes, or fats.

28 Claims, 4 Drawing Sheets

METHOD AND APPARATUS FOR COATING A MEDICAL DEVICE USING A COATING HEAD

FIELD OF THE INVENTION

The present invention relates to the coating of medical devices.

BACKGROUND OF THE INVENTION

The positioning and deployment of medical devices within a target site of a patient is a common, often-repeated procedure of contemporary medicine. These devices or implants are used for innumerable medical purposes including the reinforcement of recently re-enlarged lumens and the replacement of ruptured vessels.

Coatings are often applied to the surfaces of these medical devices to increase their effectiveness. These coatings may provide a number of benefits including reducing the trauma suffered during the insertion procedure, facilitating the acceptance of the medical device into the target site, and improving the post-procedure effectiveness of the device.

Coating medical devices also provides for the localized delivery of therapeutic agents to target locations within the body, such as to treat localized disease (e.g., heart disease) or occluded body lumens. Such localized drug delivery avoids the problems of systemic drug administration, such as producing unwanted effects on parts of the body which are not to be treated, or not being able to deliver a high enough concentration of therapeutic agent to the afflicted part of the body. Localized drug delivery is achieved, for example, by coating expandable stents, grafts, or balloon catheters, which directly contact the inner vessel wall, with the therapeutic agent to be locally delivered. Expandable stents are tube-like medical devices that often have a mesh-like patterned structure designed to support the inner walls of a lumen. These stents are typically positioned within a lumen and, then, expanded to provide internal support for it. The coating on these medical devices may provide for controlled release, which includes long-term or sustained release, of a bioactive material.

Aside from facilitating localized drug delivery, medical devices are coated with materials to provide beneficial surface properties. For example, medical devices are often coated with radiopaque materials to allow for fluoroscopic visualization during placement in the body. It is also useful to coat certain devices to achieve enhanced biocompatibility and to improve surface properties such as lubriciousness.

Conventionally, coatings have been applied to medical devices by processes such as dipping and spraying. These coating processes are, however, indiscriminate, wasteful, and difficult to control. For example, because dip-coating or spray-coating processes often indiscriminately coat the internal surface of a patterned medical device as well as the external surface, expensive coating materials, such as therapeutic agents, are wasted. In addition, when a coated medical device, such as a coated stent, is placed within a blood vessel, the wasted therapeutic coating on the internal surface of the stent washes directly into the bloodstream instead of treating the diseased walls of the lumen. Due to the toxic nature of some therapeutics, the loss of therapeutic agents into the blood stream should be minimized.

Conventional coating processes, such as dipping and spraying, also cannot apply multiple layers of different coatings without requiring appropriate drying time between coating steps. This increases production time and costs.

Also, it is often difficult to achieve coatings of uniform thicknesses, thereby placing more coating at one particular region of the medical device, making it difficult to predict the dosage of therapeutic that will be delivered. Such coating defects can compromise the stent's effectiveness.

Conventional coating techniques have drawbacks in the application of thick coating layers. Because thick coatings using a dip coating method require multiple dipping steps, and the dip coating solvent often dissolves a portion of the underlying dip coating upon a second dipping step, it is difficult to control the application of thick coatings. Spray coatings require multiple coating steps to achieve a desired coating thickness, and are thus inefficient. Also, conventional spray coating processes are limited to low viscosity coating solutions.

There is, therefore, a need for a cost-effective method and apparatus for coating the surface of medical devices that results in uniform coatings and uniform drug doses per unit device. The method would minimize coating of the internal surfaces of the medical device and also allow for the simultaneous application of multiple coating layers of high and low viscosity.

SUMMARY OF THE INVENTION

The present invention regards a method and apparatus for coating at least a portion of a medical device. In accordance with one embodiment, a method for applying at least a portion of a coating material on a medical device having a surface is provided. This method includes providing a coating head having an outlet orifice from which flows a coating material, and depositing a layer of coating material dispelled through the outlet orifice onto at least a portion of the surface of the medical device.

In another embodiment of the present invention, a method for applying a coating to at least a portion of a medical device having a surface is provided wherein a slide coating head comprising at least one orifice and slide surface is utilized to deposit at least one layer of coating material onto the surface of the medical device.

In another embodiment of the present invention, a method for applying a coating to at least a portion of a medical device having a surface is provided wherein a curtain coating head comprising at least one slide surface is utilized to deposit a layer of coating material onto the surface of the medical device.

In another embodiment of the present invention, a method for applying a therapeutic coating to a stent is provided. This method includes providing a coating head comprising at least one outlet orifice from which flows a coating material, and depositing a layer of coating material comprising a therapeutic agent onto the surface of the stent.

In another embodiment of the present invention, an apparatus for applying a coating to a medical device having a surface is provided wherein a coating head comprising at least one outlet orifice from which flows a coating material is utilized to deposit at least one layer of coating material onto the surface of the medical device.

As disclosed in references in the photographic arts, for example in U.S. Pat. No. 5,780,109 to Yapel et al. and U.S. Pat. No. 5,861,195 to Bhave et al., which are incorporated herein by reference, slot coating, slide coating, and curtain coating coaters "have been used extensively since the 1950's in the photographic and related industries for coating aqueous photographic emulsions." (Yapel, col. 1, lns. 22-24.) For example, a slide coating method or apparatus has been used in the photographic arts to deposit multiple layers of photothermographic film coating solutions to a paper-based or polymeric film-based substrate or web. However, such slot, slide, and curtain coating processes have not been previously proposed or used to coat surfaces of medical devices, such as coating the external surface of a stent or stent graft. Nor have such coating processes been previously proposed or used to deposit a coating material with a therapeutic agent.

The present invention provides methods and apparatus for coating medical devices having a surface by using slot coating heads, slide coating heads, and curtain coating heads. The methods of the present invention permit coating the external surface of the medical devices, which directly contacts the diseased vessel wall, while minimizing any wasted and deleterious coating of the internal surface of the medical device. Thus, this method permits direct local delivery of therapeutic agents to targeted diseased locations with minimal loss of therapeutic. This also allows the coatings to have uniform thicknesses and mechanical properties, and uniform drug dose.

Alternate embodiments of the present invention also permit simultaneous application of multiple layers of coating material by using a slide coating head or curtain coating head. These methods of the present invention are time efficient and cost effective because they facilitate the uniform application of multiple layers of coating materials in a single coating process step without requiring any intermediate drying step between applications of coating layers. This results in higher process efficiency. Further, slide coating heads permit the coating of high viscosity coating solutions as well as low viscosity coating solutions.

DETAILED DESCRIPTION

Figure 1:
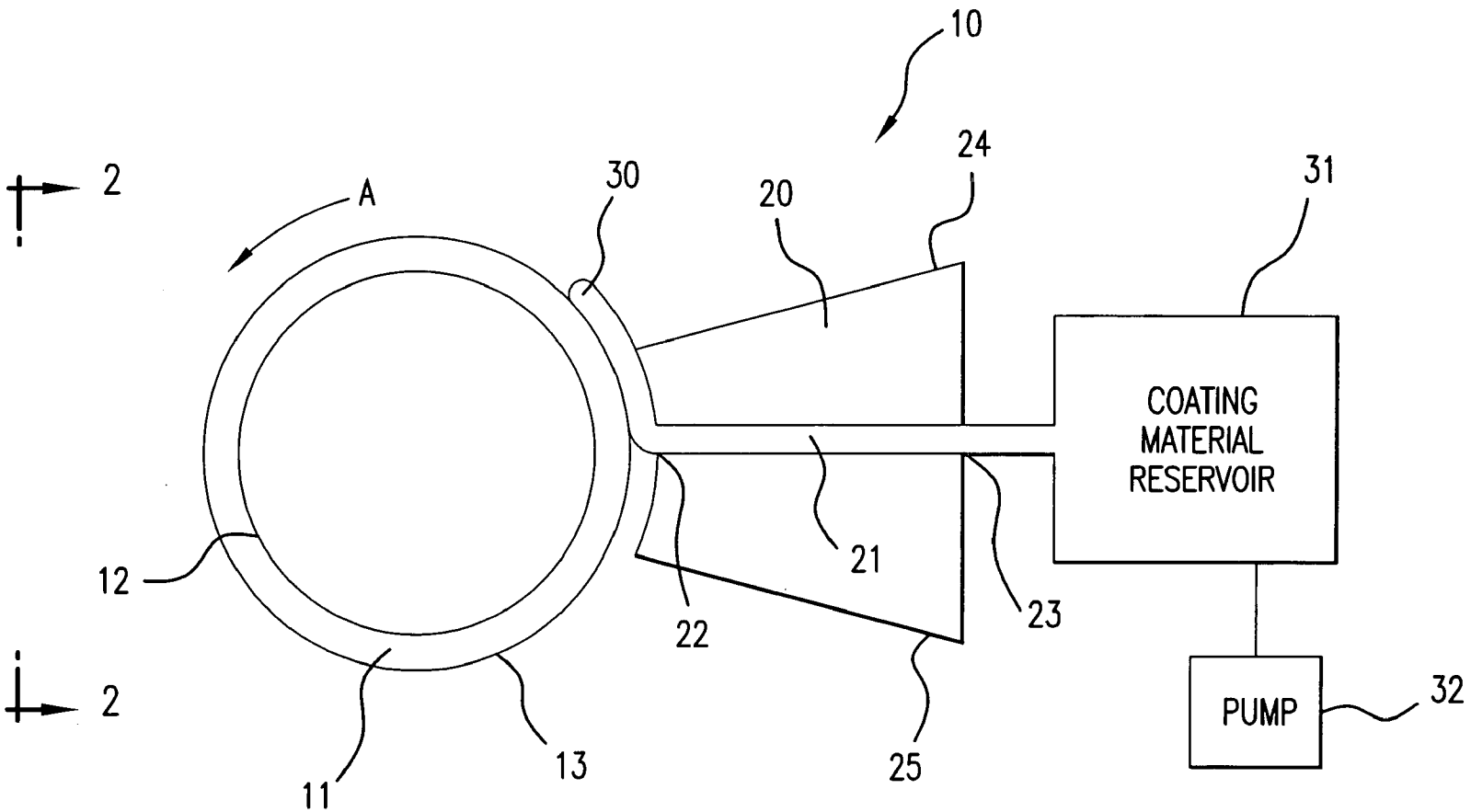
FIG. 1 is an enlarged cross-sectional view of an apparatus for coating medical devices in accordance with a first embodiment of the present invention.
Figure 2:
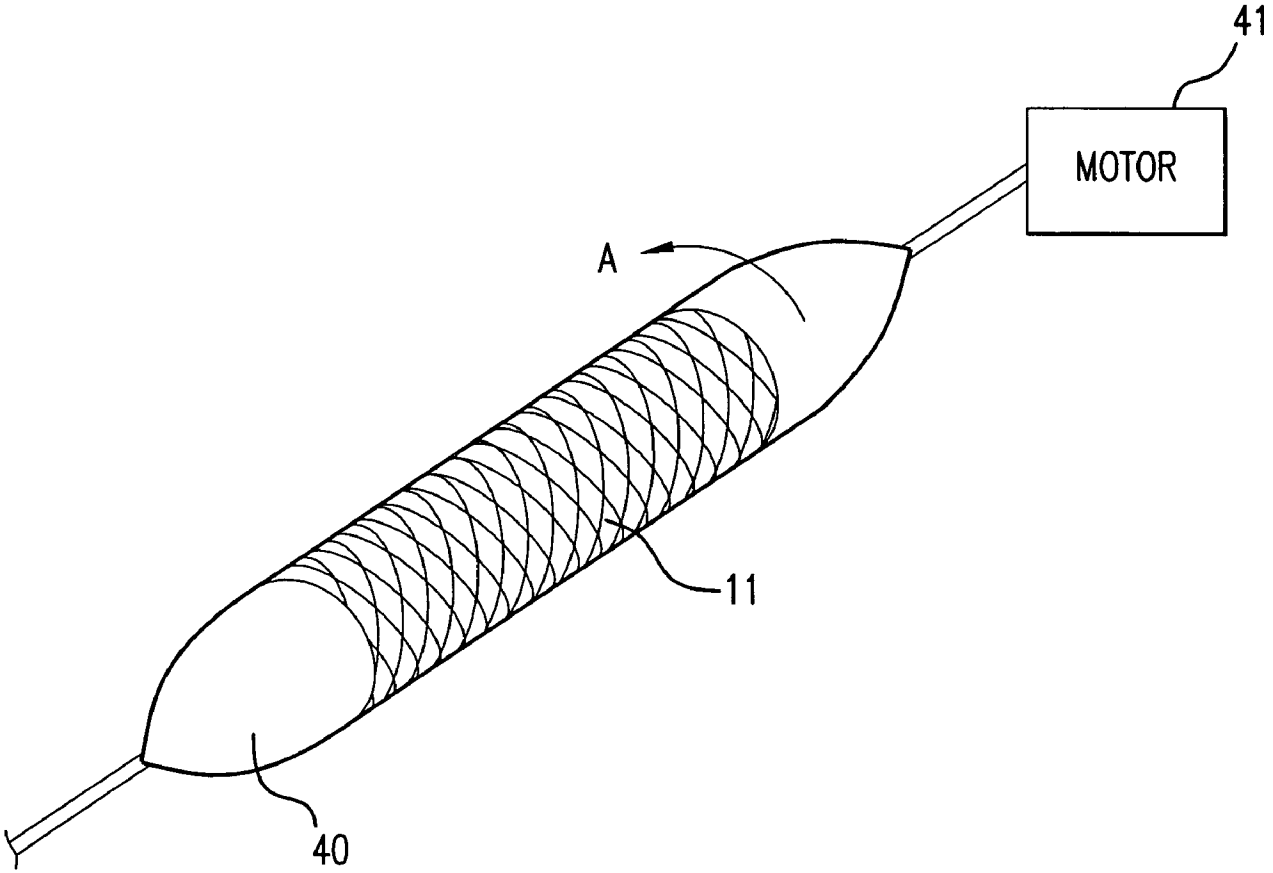
FIG. 2 is an enlarged perspective end view of one example of a medical device taken along line 2-2 of FIG. 1 and positioned on one example of a holder for holding the medical device in accordance with an alternative embodiment of the present invention. All other parts of the apparatus for coating medical devices, such as the coating head, are omitted in this view.

FIGS. 1 and 2 illustrate an apparatus for coating a medical device having an external surface in accord with one embodiment of the present invention. The apparatus in this embodiment, as shown in FIG. 1 and generally designated as 10, uses a coating head 20 to deposit a layer of coating material 30 onto an external surface 13 of medical device 11, having an internal surface 12. Coating material 30 can contain a therapeutic agent.

As depicted in FIGS. 1 and 2, the medical device 11 is positioned on a holder 40. The medical device 11 can be, for example, a stent having a patterned external surface as shown in FIG. 2. Holder 40 secures the medical device 11. The holder 40 can be, for example, an inflatable balloon, as shown, or a mandrel, which secures the medical device by exerting a force upon the internal surface 12 of the medical device, thereby permitting complete access to the external surface 13. It will be appreciated by one skilled in the art that a variety of holder devices can be designed to secure the medical device and permit access to portions of the external surface 13. By holding the medical device 11 from its internal surface 12 with a holder 40 extending the length of the medical device, the holder 40 masks the internal surface 12, thereby preventing the coating material 30 from adhering to the internal surface 12. In an alternative embodiment, holder 40 may be used to capture excess coating material that runs through any voids in medical device 11. For example, a person skilled in the art may appreciate that a vacuum system may be utilized within holder 40 to collect excess coating material. In another embodiment, holder 40 may be constructed of a porous material to capture excess coating runoff material.

Referring to FIG. 1, the medical device 11, positioned on the holder 40, is then placed in close proximity to the coating head 20 to receive the coating material 30. The coating head 20 includes a slot 21, slotted outlet orifice 22 and inlet 23. Slot 21 is a fluid passageway for coating material 30. Slot 21 can be milled or machined from coating head 20, or can be formed by adjoining a first plate 24 with a second plate 25 of coating head 20, thereby forming slot 21, outlet orifice 22, and inlet 23 at the interface of the first plate 24 and second plate 25. A skilled artisan can appreciate that a variety of designs featuring the assembly of castings, dies, plates, tubes, catheters, and other objects can form the slot or fluid passageway, or facilitate the communication of coating material from the coating material reservoir 31 to the outlet orifice 22 of the coating head.

Delivery of coating material is initiated by the pumping action by pump 32. Coating material reservoir 31 and pump 32 are in fluid communication with each other. Pumping action by pump 32 causes bio-compatible non-compressible coating material 30 to be pumped from the coating material reservoir 31, through inlet 23 of the coating head 20, and expelled from outlet orifice 22, onto the external surface 13 of medical device 11.

The holder 40 is attached to a motor 41 (shown in FIG. 2). Holder 40 and medical device 11 are then rotated at a constant speed in the direction of direction arrow A (as shown in FIGS. 1 and 2) to apply a uniform layer of coating material 30 around the external surface 13 of medical device 11. Through rotation, part or all of the entire external surface of medical device 11 can be accessed and coated. Alternatively, portions of medical device 11 may be masked to prevent coating of these areas of the surface. The pumping action by pump 32 and rotational speed of motor 41 can be controlled to allow a metered, uniform layer thickness of coating material 30 to be applied. By adjusting the width of outlet orifice 22 and controlling the rotational speed of motor 41, a thicker or thinner layer of coating material 30 can be applied. The coating apparatus may also include a vacuum system (shown generally in FIG. 3) for generating a low pressure region below the layer of coating material and between the coating head and the surface of the medical device. Applying a vacuum may enhance stability of the layer of coating material.

Holder 40 can also be rotated in a direction opposite direction arrow A. Additionally, where the medical device 11 to be coated is substantially flat or planar, like a graft, or otherwise of an unusual shape such that rotation about its longitudinal axis will not allow application of a uniform layer of coating, the surface of medical device 11 can be translated in both the X and Y Cartesian planes under the outlet orifice 22 of the coating head to receive the layer of coating material. Alternatively, the coating head 20 can translate relative to the medical device 11 so that it may be able to coat the external surface of medical device 11. Further still, movement of both the coating head 20 and medical device 11 can be coordinated such that a uniform layer of coating material 30 can be applied to the external surface 13. A skilled artisan can appreciate that medical device 11 can be masked by a variety of masking methods known in the art to prevent coating certain portions of medical device 11.

Pump 32 may be a syringe or any other pumping means that can apply a pressure on the coating material 30 to dispel it from the coating head 20. These alternative means could include a micro-pump and a collapsible bladder. In a preferred embodiment, the amount of coating material being expelled, and/or the infusion pressure placed on the coating material, will be measured to monitor the amount of coating material 30 expelled. By measuring the amount of pressure placed on the coating material the operator can monitor the progress of the procedure and thickness of the layer of the deposited coating. Thus, the coating thickness and coating flow rate can be controlled by controlling the flow rate of the coating material dispelled from the coating material reservoir, and/or controlling the translation or rotational speed of the medical device to be coated.

The coating head 20 may be made from numerous materials, including stainless steel, plastic, and other suitably rigid polymers. The holder 40, as one example, can be an inflatable balloon made with any material that is flexible and resilient. Latex, silicone, polyurethane, rubber (including styrene and isobutylene styrene), and nylon, are each examples of materials that may be used in manufacturing the inflatable balloon.

Figure 3:
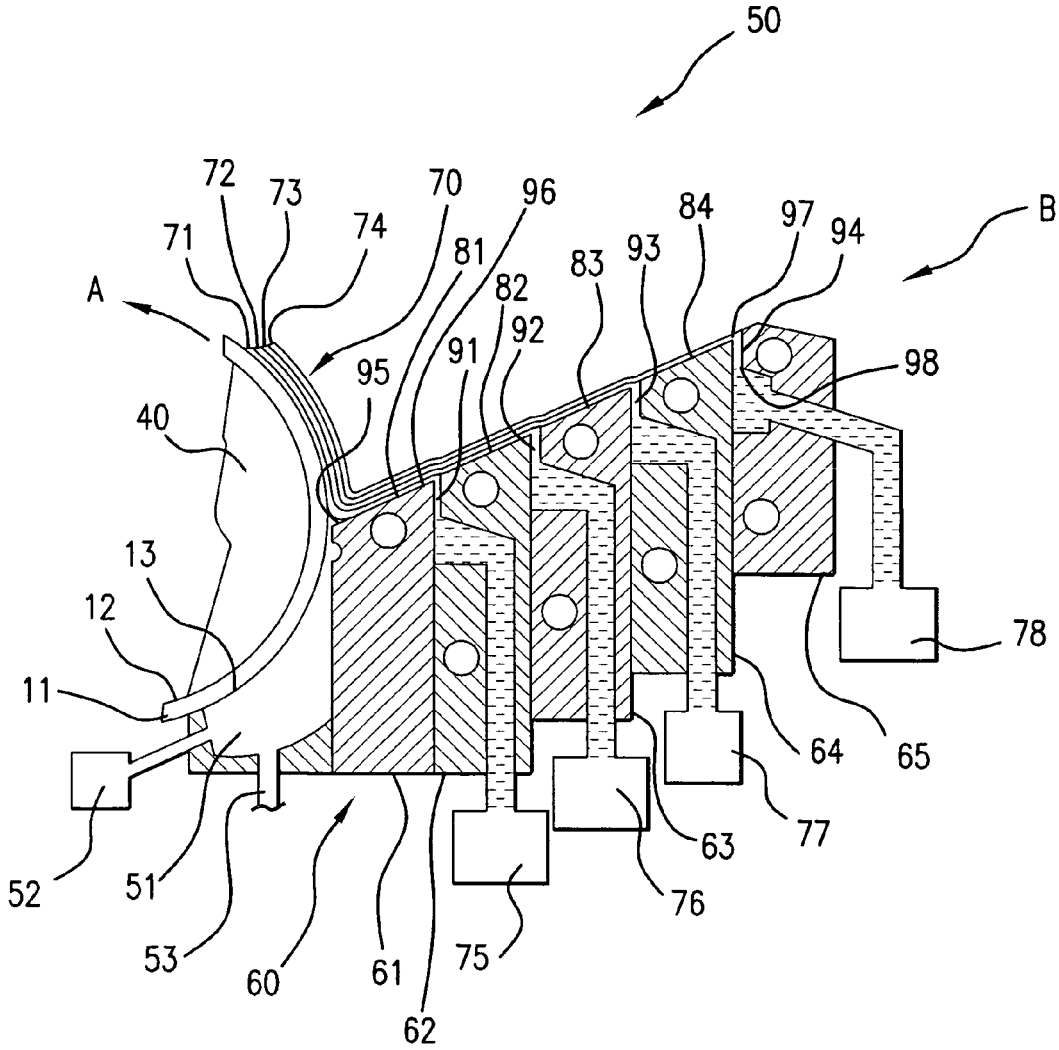
FIG. 3 is an enlarged cross-sectional view of a slide coating head in accordance with an alternative embodiment of the present invention.

In FIG. 3, an apparatus for coating a medical device in accord with another embodiment of the present invention is shown. In this embodiment, generally designated as 50, a slide coating head 60 may be used to deposit multiple layers of superposed coating material (generally, multi-layer coating material 70) onto an external surface 13 of medical device 11. This apparatus permits uniform coating of multiple layers of coating in a single coating process step without requiring any intermediate drying step between applications of coating layers. Each coating solution may be the same or a different coating solution. The individual layers of coating material are dispelled from slots 91, 92, 93, 94, each of which have inlets and outlet orifices (shown respectively as 98 and 97 for slot 94 only).

One skilled in the art can appreciate that slide coating head 60 may have slots 91, 92, 93, 94 milled or machined directly from a solid material piece at any location along the sliding surfaces 81, 82, 83, 84. Alternatively, as shown in FIG. 3, slide coating head 60 can be assembled using plates 61, 62, 63, 64, 65. Further, a skilled artisan can appreciate that a variety of designs featuring the assembly of castings, dies, tubes, catheters, and other objects can form the slot or fluid passageway, or facilitate fluid communication from the coating material reservoir to the lower end of the coating head. As shown in FIG. 3, the slide coating head 60 comprises of multiple plates 61, 62, 63, 64, 65. Plates 61, 62, 63, 64, have an inclined sliding surface 81, 82, 83, 84, from which a layer of coating material 71, 72, 73, 74, respectively, flows onto the medical device 11. Although FIG. 3 depicts a slide coating head 60 having five plates, a person skilled in the art would appreciate that any number of plates can be adapted to increase or decrease the number of layers of coating in multi-layer coating material 70.

Referring to FIG. 3, the medical device 11, such as the stent as shown, is positioned on a holder 40 wherein the holder 40 secures the medical device 11 by exerting a force upon the internal surface 12 of the medical device. Holder 40 masks the internal surface 12, thereby preventing the multi-layer coating material 70 from accessing the internal surface 12.

The medical device 11, positioned on the holder 40, is then placed in close proximity to the lower end 95 of sliding surface 81 to receive the multi-layer coating material 70. Plates 61, 62, 63, 64, 65 are assembled to form slots 91, 92, 93, 94 between the sliding surfaces 81, 82, 83, 84, from which a layer of coating material 71, 72, 73, 74, respectively, flows. Slots 91, 92, 93, 94, are fluid passageways for individual layers of coating material 71, 72, 73, 74. One of ordinary skill in the art can appreciate that slots 91, 92, 93, 94, can be formed by stacking multiple plates 61, 62, 63, 64, 65 thereby forming slots 91, 92, 93, 94, at the interface of each adjoined plate, or slots 91, 92, 93, 94 can be milled or machined directly from coating head 60 at any location along the sliding surfaces 81, 82, 83, 84. Although FIG. 3 illustrates an assembly of vertically stacked plates 61, 62, 63, 64, 65, one of ordinary skill in the art can appreciate that the plates may be stacked horizontally to form slots between the sliding surfaces wherein a series of upper and lower plates are formed. The plates may also be stacked at an angle to form the slots. One of ordinary skill in the art can appreciate that a variety of designs featuring the assembly of castings, dies, plates, tubes, catheters, and other objects can form the slot or fluid passageway, or facilitate the fluid communication from the coating material reservoir to the lower end of the coating head.

Delivery of coating material is initiated by the pumping action of pumps (not shown) for coating material reservoir 75, 76, 77, 78. Pumping action by the pump forces coating material 71, 72, 73, 74, to be pumped from the coating material reservoir, along the slot 91, 92, 93, 94, of the coating head 60, and expelled onto the inclined sliding surface 81, 82, 83, 84.

The coating material flows down the inclined sliding surface in a downward direction, depicted by direction arrow B, from a raised end (shown generally as 96 on sliding surface 81) to a lower end (shown generally as 95 on sliding surface 81) of each sliding surface due to the gravity weight of the coating material. As a layer of coating material (e.g., coating material 74) flows downward due to gravitational fluid flow and crosses from a higher sliding surface (e.g., sliding surface 84) to a lower sliding surface (e.g., sliding surface 83), it flows over the layer of coating material originating from the slot in the lower sliding surface (e.g., coating material 73), thereby forming a multiple coating layer composed of distinct superposed layers. Thus, as illustrated in FIG. 3, multi-layer coating material 70 will be comprised of distinct, multiple layers of coating material 71, 72, 73, 74. The individual layers of coating material may be controlled by metering flow from the slots at the same speed or varying speeds.

The properties of multi-layer coating material 70 can be controlled by selecting the various constituent coating materials 71, 72, 73, 74, and the order of layering for the individual coating materials. For example, coatings to deliver therapeutic agents may have the therapeutic agent as the top layer coating material 74, which would be in contact with the vessel wall, and a polymer binding agent as coating material 73. In one embodiment, at least one layer of a multi-layer coating material (e.g., the bottom layer 71 as depicted in FIG. 3) may not contain any polymer or therapeutic agent to act as a carrier layer in facilitating the application of a layer containing a therapeutic agent. Selection or order of constituent coating materials for their viscosity and surface tension properties will assist in maintaining stratification of multi-layer coating material 70. The superposed coating materials generally do not mix, although some interfacial mixing and adhesion may occur. Applications of multi-layer coating material 70 that require enhanced adhesion of the layers may warrant selection of adjacent coating materials that promote interfacial mixing at their interfaces.

Multi-layer coating material 70 is deposited onto surface 13 of medical device 11 by rotating holder 40 and medical device 11 at a constant speed in the direction of direction arrow A to apply a uniform layer of multi-layer coating material 70 around the external surface 13 of medical device 11. Alternatively, holder 40, slide coating head 60, or both can be translated in both the X and Y Cartesian planes, or rotated relative to each other to deposit multi-layer coating material 70 onto medical device 11. The pumping action by the pumps and rotational speed of the holder 40 can be controlled to allow a metered, uniform layer thickness of multi-layer coating material 70 to be applied. Thus, the coating thickness and coating flow rate can be controlled by controlling the flow rate of the coating material dispensed from the coating material reservoir, or controlling the speed of translation or rotation of the medical device. In an alternative embodiment, controlling the angle of the inclined slide surface may also permit some control of the coating flow rate and thickness.

The slide coating head may also include a vacuum box 51, shown in FIG. 3, for generating a low pressure region below the layer of coating material and between the coating head 60 and surface 13 of the medical device 11. The vacuum box 51 stabilizes the coating process by maintaining a differential pressure across the coating material 70. Vacuum pump 52 adjusts the vacuum level of vacuum box 51. Drain 53 may be added to collect coating material 70. Applying a vacuum may enhance stability and control thickness over the layer of coating material.

Figure 4:
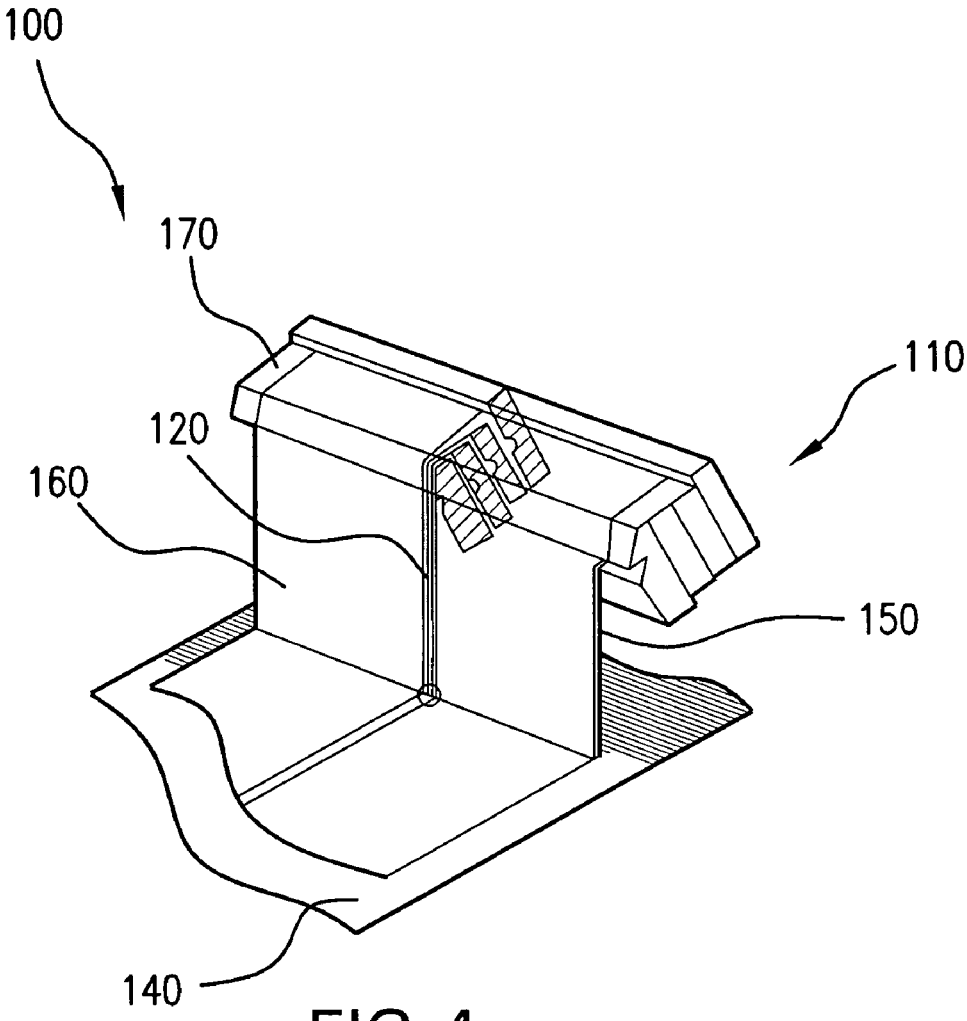
FIG. 4 is an enlarged perspective view of a curtain coating head in accordance with an alternative embodiment of the present invention.

In FIG. 4, an apparatus for coating a medical device having a surface in accord with another embodiment of the present invention is shown. In this embodiment, generally designated as 100, a curtain coating head 110 may be used to deposit multiple layers of superposed coating material (generally, multi-layer coating material 120) onto an external surface of medical device 140. The curtain head can also be adapted to deposit a single layer of coating material. This apparatus permits uniform coating of multiple layers of coating in a single coating process step without requiring any intermediate drying step between applications of coating layers. Each coating solution may be the same or a different coating solution.

As shown in FIG. 4, the curtain coating head 110 comprises multiple plates, similar to the embodiment as depicted in FIG. 3. However, in FIG. 4, a curtain 160 of multi-layer coating material 120 falls from the lower end of sliding surface 170 onto the external surface of medical device 140. Curtain coating head 110 also includes an edge guide 150 to facilitate uniform deposition of curtain 160 onto medical device 140. The edge guide may also be utilized in the slot coating feeder or slide coating feeder apparatuses illustrated in FIGS. 1 through 3. Although medical device 140 is depicted as having a planar surface, such as a graft, in FIG. 4, curtain coating head 110 can be used to coat a medical device having a non-planar external surface, such as a stent.

The medical devices used in conjunction with the present invention include any device amenable to the coating processes described herein. The medical device, or portion of the medical device, to be coated or surface modified may be made of metal, polymers, ceramics, composites or combinations thereof. Whereas the present invention is described herein with specific reference to a vascular stent, other medical devices within the scope of the present invention include any devices which are used, at least in part, to penetrate the body of a patient. Examples include implantable devices such as vascular grafts, stent grafts, biliary stents, colonic stents, bronchial/pulmonary stents, esophageal stents, ureteral stents, aneurysm filling coils and other coiled coil devices, catheters, needle injection catheters, blood clot filters, trans-myocardial revascularization ("TMR") devices, percutaneous myocardial revascularization ("PMR") devices etc., as are known in the art, as well as devices such as hypodermic needles, soft tissue clips, holding devices, and other types of medically useful needles and closures. Any exposed surface of these medical devices may be coated with the methods and apparatuses of the present invention.

The coating materials used in conjunction with the present invention are any desired, suitable substances. In some embodiments, the coating materials comprise therapeutic agents, applied to the medical devices alone or in combination with solvents in which the therapeutic agents are at least partially soluble or dispersible or emulsified, and/or in combination with polymeric materials as solutions, dispersions, suspensions, lattices, etc. The solvents may be aqueous or non-aqueous. Coating materials with solvents may be dried or cured, with or without added external heat, after being deposited on the medical device to remove the solvent. In another embodiment, the coating materials comprise a solvent solution that does not include therapeutic agents (e.g. a barrier layer coating). The term "therapeutic agents" include pharmaceutically active compounds, nucleic acids with and without carrier vectors such as lipids, compacting agents (such as histones), virus, polymers, proteins, and the like, with or without targeting sequences. The coating on the medical devices may provide for controlled release, which includes long-term or sustained release, of a bioactive material.

Specific examples of therapeutic or bioactive agents used in conjunction with the present invention include, for example, pharmaceutically active compounds, proteins, oligonucleotides, ribozymes, anti-sense genes, DNA compacting agents, gene/vector systems (i.e., anything that allows for the uptake and expression of nucleic acids), nucleic acids (including, for example, recombinant nucleic acids; naked DNA, cDNA, RNA; genomic DNA, cDNA or RNA in a non-infectious vector or in a viral vector which may have attached peptide targeting sequences; antisense nucleic acid (RNA or DNA); and DNA chimeras which include gene sequences and encoding for ferry proteins such as membrane translocating sequences ("MTS") and herpes simplex virus-1 ("VP22")), and viral liposomes and cationic polymers that are selected from a number of types depending on the desired application. For example, biologically active solutes include anti-thrombogenic agents such as heparin, heparin derivatives, urokinase, and PPACK (dextrophenylalanine proline arginine chloromethylketone); prostaglandins, prostacyclins/prostacyclin analogs; antioxidants such as probucol and retinoic acid; angiogenic and anti-angiogenic agents; agents blocking smooth muscle cell proliferation such as rapamycin, angiopeptin, and monoclonal antibodies capable of blocking smooth muscle cell proliferation;

anti-inflammatory agents such as dexamethasone, prednisolone, corticosterone, budesonide, estrogen, sulfasalazine, acetyl salicylic acid, and mesalamine, lipoxygenase inhibitors; calcium entry blockers such as verapamil, diltiazem and nifedipine; antineoplastic/antiproliferative/anti-mitotic agents such as paclitaxel, 5-fluorouracil, methotrexate, doxorubicin, daunorubicin, cyclosporine, cisplatin, vinblastine, vincristine, colchicine, epothilones, endostatin, angiostatin, Squalamine, and thymidine kinase inhibitors; L-arginine; antimicrobials such as triclosan, cephalosporins, aminoglycosides, and nitrofurantoin; anesthetic agents such as lidocaine, bupivacaine, and ropivacaine; nitric oxide (NO) donors such as linsidomine, molsidomine, NO-protein adducts, NO-polysaccharide adducts, polymeric or oligomeric NO adducts or chemical complexes; anti-coagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, Warfarin sodium, Dicumarol, aspirin, prostaglandin inhibitors, platelet inhibitors and tick antiplatelet factors; interleukins, interferons, and free radical scavengers; vascular cell growth promoters such as growth factors, growth factor receptor antagonists, transcriptional activators, and translational promoters; vascular cell growth inhibitors such as growth factor inhibitors (e.g., PDGF inhibitor—Trapidil), growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; Tyrosine kinase inhibitors, chymase inhibitors, e.g., Tranilast, ACE inhibitors, e.g., Enalapril, MMP inhibitors, (e.g., Ilomastat, Metastat®), GP IIb/IIIa inhibitors (e.g., Intergrilin®, abciximab), serotonin antagnonist, and 5-HT uptake inhibitors; cholesterol-lowering agents; vasodilating agents; agents which interfere with endogenous vascoactive mechanisms; survival genes which protect against cell death, such as anti-apoptotic Bcl-2 family factors and Akt kinase; and combinations thereof; and beta blockers. These and other compounds may be added to a coating solution, including a coating solution that includes a polymer, using similar methods and routinely tested as set forth in the specification. Any modifications are routinely made by one skilled in the art.

Polynucleotide sequences useful in practice of the invention include DNA or RNA sequences having a therapeutic effect after being taken up by a cell. Examples of therapeutic polynucleotides include anti-sense DNA and RNA; DNA coding for an anti-sense RNA; or DNA coding for tRNA or rRNA to replace defective or deficient endogenous molecules. The polynucleotides of the invention can also code for therapeutic proteins or polypeptides. A polypeptide is understood to be any translation product of a polynucleotide regardless of size, and whether glycosylated or not. Therapeutic proteins and polypeptides include as a primary example, those proteins or polypeptides that can compensate for defective or deficient species in an animal, or those that act through toxic effects to limit or remove harmful cells from the body. In addition, the polypeptides or proteins that can be incorporated into the polymer coating, or whose DNA can be incorporated, include without limitation, angiogenic factors and other molecules competent to induce angiogenesis, including acidic and basic fibroblast growth factors, vascular endothelial growth factor, hif-1, epidermal growth factor, transforming growth factor $\alpha$ and $\beta$, platelet-derived endothelial growth factor, platelet-derived growth factor, tumor necrosis factor $\alpha$, hepatocyte growth factor and insulin like growth factor; growth factors; cell cycle inhibitors including CDK inhibitors; anti-restenosis agents, including p15, p16, p18, p19, p21, p27, p53, p57, Rb, nFkB and E2F decoys, thymidine kinase ("TK") and combinations thereof and other agents useful for interfering with cell proliferation, including agents for treating malignancies; and combinations thereof. Still other useful factors, which can be provided as polypeptides or as DNA encoding these polypeptides, include monocyte chemoattractant protein ("MCP-1"), and the family of bone morphogenic proteins ("BMP's"). The known proteins include BMP-2, BMP-3, BMP-4, BMP-5, BMP-6 (Vgr-1), BMP-7 (OP-1), BMP-8, BMP-9, BMP-10, BMP-11, BMP-12, BMP-13, BMP-14, BMP-15, and BMP-16. Currently preferred BMPs are any of BMP-2, BMP-3, BMP-4, BMP-5, BMP-6 and BMP-7. These dimeric proteins can be provided as homodimers, heterodimers, or combinations thereof, alone or together with other molecules. Alternatively, or in addition, molecules capable of inducing an upstream or downstream effect of a BMP can be provided. Such molecules include any of the "hedgehog" proteins, or the DNAs encoding them.

Coating materials other than therapeutic agents include, for example, polymeric materials, sugars, waxes, and fats, applied alone or in combination with therapeutic agents, and monomers that are cross-linked or polymerized. Such coating materials are applied in the form of, for example, solutions, dispersions, suspensions, and/or emulsions of one or more polymers, optionally in aqueous and/or organic solvents and combinations thereof or optionally as liquid melts including no solvents. When used with therapeutic agents, the polymeric materials are optionally applied simultaneously with, or in sequence to (either before or after), the therapeutic agents. Such polymeric materials employed as, for example, primer layers for enhancing subsequent coating applications (e.g., application of alkanethiols or sulfhydryl-group containing coating solutions to gold-plated devices to enhance adhesion of subsequent layers), layers to control the release of therapeutic agents (e.g., barrier diffusion polymers to sustain the release of therapeutic agents, such as hydrophobic polymers; thermal responsive polymers; pH-responsive polymers such as cellulose acetate phthalate or acrylate-based polymers, hydroxypropyl methylcellulose phthalate, and polyvinyl acetate phthalate), protective layers for underlying drug layers (e.g., impermeable sealant polymers such as ethylcellulose), biodegradable layers, biocompatible layers (e.g., layers comprising albumin or heparin as blood compatible biopolymers, with or without other hydrophilic biocompatible materials of synthetic or natural origin such as dextrans, cyclodextrins, polyethylene oxide, and polyvinyl pyrrolidone), layers to facilitate device delivery (e.g., hydrophilic polymers, such as polyvinyl pyrrolidone, polyvinyl alcohol, polyalkylene glycol (i.e., for example, polyethylene glycol), or acrylate-based polymer/copolymer compositions to provide lubricious hydrophilic surfaces), drug matrix layers (i.e., layers that adhere to the medical device and have therapeutic agent incorporated therein or thereon for subsequent release into the body), and epoxies.

When used as a drug matrix layer for localized drug delivery, the polymer coatings of the present invention comprise any material capable of absorbing, adsorbing, entrapping, or otherwise holding the therapeutic agent to be delivered. The material is, for example, hydrophilic, hydrophobic, and/or biodegradable, and is preferably selected from the group consisting of polycarboxylic acids, cellulosic polymers, gelatin, polyvinylpyrrolidone, maleic anhydride polymers, polyamides, polyvinyl alcohols, polyethylene oxides, glycosaminoglycans, polysaccharides, polyesters, polyurethanes, silicones, polyurea, polyacrylate, polyacrylic acid and copolymers, polyorthoesters, polyanhydrides such as maleic anhydride, polycarbonates, polyethylene, polypropylenes, polylactic acids, polystyrene, natural and synthetic rubbers and elastomers such as polyisobutylene, polyisoprene, polybutadiene, including elastomeric copolymers, such as KRATON®, styrene-isobutylene-styrene (SIBS) copolymers; polyglycolic acids, polycaprolactones, polyhydroxybutyrate valerates, polyacrylamides, polyethers, polysaccharides such as cellulose, starch, dextran and alginates; polypeptides and proteins including gelatin, collagen, albumin, fibrin; copolymers of vinyl monomers such as ethylene vinyl acetate (EVA), polyvinyl ethers, polyvinyl aromatics; other materials such as cyclodextrins, hyaluronic acid and phosphorylcholines; and mixtures and copolymers thereof. Coatings from polymer dispersions such as polyurethane dispersions (BAYHYDROL®, etc.) and acrylic latex dispersions are also within the scope of the present invention. In one embodiment, the polymer is polyacrylic acid available as HYDROPLUS® (Boston Scientific Corporation, Natick, Mass.), and described in U.S. Pat. No. 5,091,205, the disclosure of which is incorporated by reference herein. In other embodiments, the polymer is a co-polymer of polylactic acid and polycaprolactone; polyurethane; or an aqueous coating compositions comprising an aqueous dispersion or emulsion of a polymer having organic acid functional groups and a polyfunctional crosslinking agent having functional groups capable of reacting with organic acid groups, as described in U.S. Pat. No. 5,702,754, the disclosure of which is also incorporated herein by reference.

The release rate of drugs from drug matrix layers is largely controlled, for example, by variations in the polymer structure and formulation, the diffusion coefficient of the matrix, the solvent composition, the ratio of drug to polymer, potential chemical reactions and interactions between drug and polymer, the thickness of the drug adhesion layers and any barrier layers, and the process parameters, e.g., drying, etc. The coating(s) applied by the methods and apparatuses of the present invention may allow for a controlled release rate of a coating substance with the controlled release rate including both long-term and/or sustained release.

The coatings of the present invention are applied such that they result in a suitable thickness, depending on the coating material and the purpose for which the coating(s) is applied. It is also within the scope of the present invention to apply multiple layers of the same or different coating materials, which may perform identical or different functions (e.g., to provide for biocompatibility, to control drug release, etc.).

In addition to the previously described coating layers and their purposes, in the present invention the coating layer or layers may be applied for any of the following additional purposes or combination of the following purposes: to alter surface properties such as lubricity, contact angle, hardness, or barrier properties; to improve corrosion, humidity and/or moisture resistance; to improve fatigue, mechanical shock, vibration, and thermal cycling; to change/control composition at surface and/or produce compositionally graded coatings; to apply controlled crystalline coatings; to apply conformal pinhole free coatings; to minimize contamination; to change radiopacity; to impact bio-interactions such as tissue/blood/fluid/cell compatibility, anti-organism interactions (fungus, microbial, parasitic microorganisms), immune response (masking); to control release of incorporated therapeutic agents (agents in the base material, subsequent layers or agents applied using the above techniques or combinations thereof); or any combinations of the above using single or multiple layers.

One of skill in the art will realize that the examples described and illustrated herein are merely illustrative, as numerous other embodiments may be implemented without departing from the spirit and scope of the present invention.

What is claimed is:

1. A method for coating at least a portion of an implantable medical device with a coating material comprising:

providing an implantable medical device having a surface;

providing a slide coating head wherein the slide coating head comprises a slide surface adapted to facilitate gravitational fluid flow on the slide surface, and an inlet and an outlet orifice;

flowing a coating material into the inlet;

dispelling the coating material through the outlet orifice onto the slide surface;

flowing the coating material down the slide surface; and gravitationally depositing the coating material from the slide surface onto the surface of the medical device by unassisted gravitational flow.

2. The method of claim 1 further comprising translating the medical device relative to the coating head while the coating material is deposited on the surface of the medical device.

3. The method of claim 1 further comprising rotating the medical device about a longitudinal axis wherein the coating material is deposited on the surface of the medical device.

4. The method of claim 1 further comprising translating the coating head relative to the medical device while the coating material is deposited on the surface of the medical device.

5. The method of claim 1 further comprising controlling the flow of coating material onto the medical device.

6. The method of claim 1 wherein the coating head further comprises a first plate and second plate.

7. The method of claim 6 wherein the first plate and second plate are assembled to form the outlet orifice between the first plate and second plate.

8. The method of claim 1 wherein the coating head further comprises an upper plate and a lower plate.

9. The method of claim 1 wherein the medical device is a stent.

10. The method of claim 1 wherein the coating material comprises a therapeutic agent.

11. The method of claim 10 wherein the therapeutic agent is selected from the group consisting of pharmaceutically active compounds, proteins, oligonucleotides, DNA compacting agents, recombinant nucleic acids, gene/vector systems, and nucleic acids.

12. The method of claim 1 wherein the coating material comprises a solvent.

13. The method of claim 1 wherein the coating material comprises a polymer, sugar, wax, fat or solvent.

14. The method of claim 1 wherein the coating head is a curtain coating head.

15. The method of claim 1 further comprising a holder that holds the medical device for coating.

16. A method for coating at least a portion of an implantable medical device with at least two layers of coating material comprising:

providing an implantable medical device having a surface;

providing a slide coating head, wherein the slide coating head comprises at least a first slide surface and second slide surface, wherein the first slide surface is adjacent the second slide surface and each of the first slide surface and second slide surface is adapted to facilitate gravitational fluid flow on each of the slide surfaces, and at least a first inlet and first outlet orifice and second inlet and second outlet orifice;

flowing a first coating material into the first inlet;

flowing a second coating material into the second inlet;

dispelling the first coating material through the first outlet orifice onto the first slide surface;

dispelling the second coating material through the second outlet orifice onto the second slide surface;

flowing the first coating material down the first slide surface;

flowing the second coating material down the second slide surface, wherein the second slide surface is oriented relative to the first slide surface such that the second coating material flows on top of the first coating material on the first slide surface forming a multi-layer coating material having a layer of second coating material above a layer of first coating material; and depositing the multi-layer coating material onto the surface of the medical device.

17. The method of claim 16 further comprising translating the medical device relative to the coating head while the multi-layer coating material is deposited on the surface of the medical device.

18. The method of claim 16 further comprising rotating the medical device about a longitudinal axis wherein the multi-layer coating material is deposited on the surface of the medical device.

19. The method of claim 16 further comprising translating the coating head relative to the medical device while the multi-layer coating material is deposited on the surface of the medical device.

20. The method of claim 16 wherein the medical device is a stent.

21. The method of claim 16 wherein at least one layer of the multi-layer coating material comprises a therapeutic agent.

22. The method of claim 16 wherein at least one layer of the multi-layer coating material comprises a polymer, sugar, wax, or fat.

23. The method of claim 16 wherein at least one layer of the multi-layer coating material further comprises a solvent.

24. The method of claim 16 wherein the slide coating head further comprises a plurality of plates.

25. The method of claim 24 wherein the plurality of plates are assembled to form a plurality of outlet orifices between the plurality of plates.

26. The method of claim 16 wherein the coating head is a curtain coating head.

27. A method for coating at least a portion of a medical device with a coating material comprising:

providing a medical device having a surface, wherein the medical device is a stent;

providing a slide coating head wherein the slide coating head comprises a slide surface adapted to facilitate gravitational fluid flow on the slide surface, and at least one inlet and at least one outlet orifice;

flowing a coating material comprising a therapeutic agent into said at least one inlet;

dispelling the coating material through said at least one outlet orifice onto the slide surface;

flowing the coating material down the slide surface; and gravitationally depositing the coating material from the slide surface onto the surface of the medical device by unassisted gravitational flow.

28. The method of claim 27, wherein the coating head is a curtain coating head.

* * * * *